US005429284A

United States Patent [19]

Kolton et al.

[11] Patent Number: 5,429,284

[45] Date of Patent: Jul. 4, 1995

[54] GARMENT HANGER FOR TIES WITH PLURAL OPENINGS

[75] Inventors: Chester Kolton, Westfield; Stuart S. Spater, Livingston, both of N.J.

[73] Assignee: B&G Plastics, Inc., Newark, N.J.

[21] Appl. No.: 179,909

[22] Filed: Jan. 11, 1994

Related U.S. Application Data

[63] Continuation-in-part of Ser. No. 39,864, Mar. 30, 1993, Pat. No. 5,328,065.

[51] Int. Cl.[6] ..... A47G 25/34; A47G 25/14

[52] U.S. Cl. ..... 223/85; 223/87; 223/DIG. 1

[58] Field of Search ..... 223/DIG. 1, 94, 89, 223/85, 87, 88; D6/315

[56] References Cited

U.S. PATENT DOCUMENTS

| | | | |
|---|---|---|---|
| 2,626,733 | 1/1953 | Gwinn et al. | 223/87 |
| 3,065,946 | 11/1962 | Berkow | 223/87 |
| 3,243,087 | 3/1966 | Pulitzer | 223/87 |
| 3,755,859 | 9/1973 | Solari | 223/87 |
| 3,790,045 | 2/1974 | Rigel et al. | 223/87 |
| 4,063,669 | 12/1977 | Smilow et al. | 223/87 |
| 4,932,571 | 6/1990 | Blachard | 223/94 |
| 5,123,577 | 6/1992 | Kolton et al. | 223/DIG. 1 |
| 5,222,638 | 6/1993 | Kolton et al. | 223/DIG. 1 |

*Primary Examiner*—Clifford D. Crowder
*Assistant Examiner*—Bibhu Mohanty
*Attorney, Agent, or Firm*—Robin, Blecker, Daley & Driscoll

[57] ABSTRACT

A garment hanger is comprised of a one-piece body having a hook portion for the receipt of a display rod, a central portion depending from the hook portion and having first and second openings therein, and a lower portion defining a fold line segment depending from the central portion with a third opening disposed in the fold line segment and a flap segment depending from the fold line segment. The central portion and the flap segment define coactive structure for retaining the flap segment against the central portion on folding of the flap segment about the fold line segment.

19 Claims, 3 Drawing Sheets

GARMENT HANGER FOR TIES WITH PLURAL OPENINGS

CROSS-REFERENCE TO RELATED APPLICATION

This application is a continuation-in-part of application Ser. No. 039,864, filed on Mar. 30, 1993 and entitled GARMENT HANGER now U.S. Pat. No. 5,328,065.

FIELD OF THE INVENTION

This invention relates generally to hangers for garments and pertains more particularly to hangers for enhanced retention of garments, such as ties.

BACKGROUND OF THE INVENTION

FIGS. 1–3 depict a presently known commercial tie hanger 10, comprised of an integral plastic body having a first flap portion 12, having a generally trapezoidal cutout 14. Hanger 10 has a fold segment portion defined by fold line parts 16 and 18, each contiguous with flap portion 12 and of lesser depth than the depth of hanger 10 generally, as is seen particularly for fold line part 18 in FIG. 2.

A second flap portion 20 is contiguous with fold line parts 16 and 18 and includes a hook 22 having slot 22A for receipt of a display rod and tie receiving openings 24, 26 and 28 and latching openings 30 and 32.

On its rearward side, hanger 10 includes latching projections 34, each inclusive of shank 36, having a diameter somewhat less than that of openings 30 and 32, and having detents 38L(left side) and 38R(right side), respectively for forced passage through openings 30 and 32 and sized to be larger in diameter than the diameters of openings 30 and 32.

In use of hanger 10, a tie is passed through opening 24 and the rearward course of the tie is then passed through opening 26 to meet with the forward course of the tie. Then, both courses of the tie are jointly passed through opening 28 to be dressed rearwardly jointly of second flap portion 20 to extend therebelow. At that juncture, first flap portion 12 is folded about fold line parts 16 and 18 and detents 38L and 38R are forced into openings 30 and 32 to provide for capture of the two tie courses between flaps 12 and 20.

As is seen particularly in FIG. 3, the fold line parts 16 and 18 appear to the side of hanger 10 as so folded. Further, a quite extensive amount of plastic material is involved in hanger 10, i.e., the folded flaps 12 and 20 are coextensive, save for hook 22 and cutout 14.

From applicants' perspective, the appearance of the fold line parts outwardly of hanger 10 is aesthetically undesirable. More importantly, the need for generally coextensive folded members for retaining the two courses of the tie exiting the hanger consumes undue plastic material.

By way of further introduction to the subject invention, with reference to the above-noted parent application, it provides a garment hanger comprised of an upstanding integral plastic body having a hook portion and a main body portion depending from the hook portion, the main body portion defining first and second horizontally extending openings therethrough with a first upper continuous course of the main body portion upwardly bounding the first opening and a second lower continuous course of the main body portion lowerly bounding the second opening, the main body portion supporting first and second horizontally extending arms respectively lowerly bounding the first opening and upwardly bounding the second opening, the first and second arms having respective free ends in interfering disposition vertically of said hanger. Based on such interfering disposition, the hanger of the parent application affords enhanced retention of hung garments, particularly ties, since the hung garment does not have an escape passage through the interfering arms.

SUMMARY OF THE INVENTION

The present invention has as its primary object the provision of improved garment hangers, particularly for tie-hanging.

A more particular object of the invention is to provide tie hangers generally of the type having a foldable retaining portion, as in the hanger of FIGS. 1–3, but requiring substantially less plastic material and providing a more aesthetically pleasing appearance.

A further object of the invention is to provide tie hangers generally of the type shown in the parent application, but with an enhanced tie retention aspect.

In attaining the foregoing and other objects, the invention provides a garment hanger comprised of a one-piece body having a hook portion for the receipt of a display rod, a central portion depending from the hook portion and having first and second openings therein, and a lower portion defining a fold line segment depending from the central portion with a third opening disposed in the fold line segment and a flap segment depending from the fold line segment. The central portion and the flap segment define coactive structure for retaining the flap segment against the central portion on folding of the flap segment about the fold line segment. The coactive structure is preferably comprised of first and second projections on the flap segment adjacent respective lateral margins thereof and first and second latching openings in the central portion adjacent respective lateral margins thereof.

In use of the hanger, with the flap segment unfolded, a garment, such as a tie, is looped through the first and second openings and then passed through the third opening. The flap is now folded against the tie and latched to the central portion.

The foregoing and other objects and features of the invention will be further evident from the following detailed description of preferred embodiments thereof and from the drawings in which like components are identified by like reference numerals throughout.

DETAILED DESCRIPTION OF PREFERRED EMBODIMENTS AND PRACTICES

Figure 1:
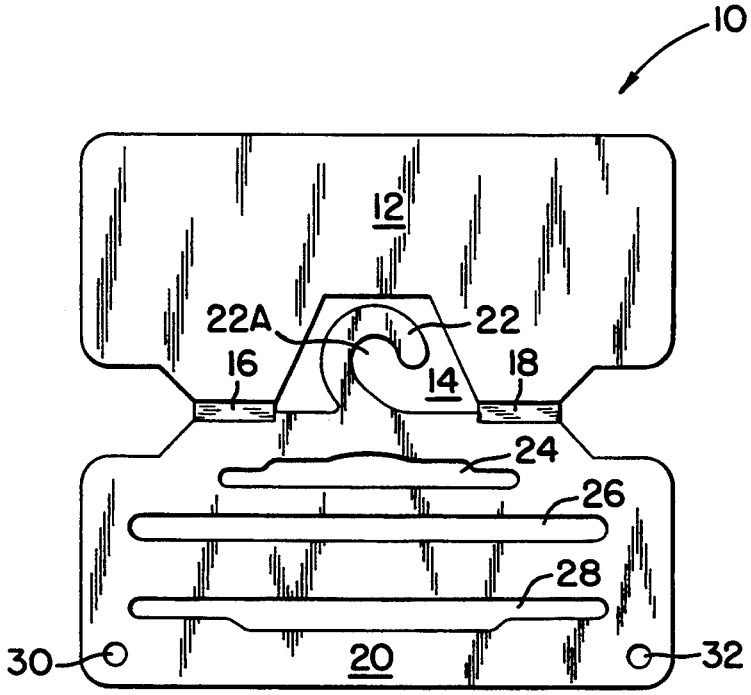
FIG. 1 (PRIOR ART)
FIG. 1 is a front elevational view of a prior art hanger.

Referring to FIGS. 4–7, garment hanger 40 is comprised of a one-piece synthetic plastic body having a hook portion 42 with a slot 42A for the receipt of a display rod. A central portion of hanger 40 depends from hook portion 42 and has first and second arms 44 and 46 and first and second openings 48 and 50. The central portion also includes latching openings 52 and 54 adjacent respective lateral margins thereof.

A lower portion of hanger 40 has a fold line segment, depending from the central portion and constituted by thinning out the one-piece body to have lessened thickness in fold line parts 56B and 56C, which bound fold line segment opening 56. A flap segment depends from the fold line segment and includes a panel 58 with latching projections 60 and 62.

The latching openings and projections constitute coactive structure for retaining the flap segment against the central portion on folding of the flap segment about the fold line segment. While the hanger may be constructed such that the retention is releasable, it is preferred that the retention not be releasable and that cutting is required to remove a hung garment from the hanger. Incorporating reference is made in this respect to commonly-owned U.S. Pat. No. 5,005,741, which depicts non-releasable projection and latching recess structure.

A first upper continuous course of the central body portion upwardly bounds opening 48 and a second lower continuous course of the central body portion lowerly bounds opening 50. The central body portion supports the first and second horizontally extending arms 44 and 46 respectively lowerly bounding opening 48 and upwardly bounding opening 50. Arms 44 and 48 have respective free ends in interfering disposition vertically of the hanger, which free ends are disposed in horizontally spaced relation to each other. Each of the arms 44 and 48 define at the free ends an intermediate course extending generally downwardly of the hanger and a further course extending to the free end of the arm, the further courses being in interfering disposition vertically of the hanger.

Figure 2:
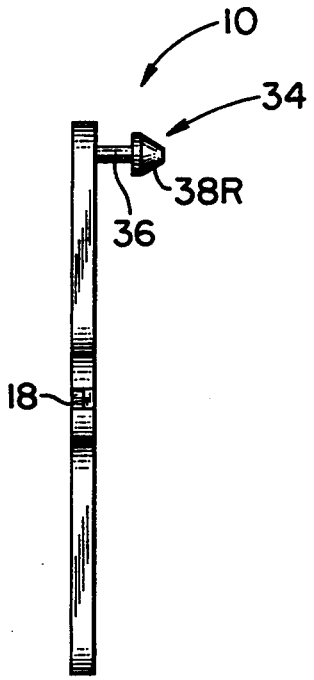
FIG. 2 (PRIOR ART)
FIG. 2 is a right side elevational view of the FIG. 1 hanger.
Figure 3:
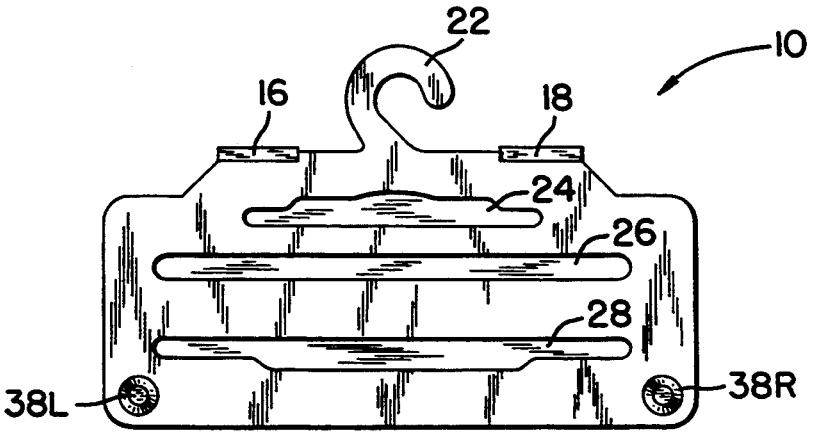
FIG. 3 (PRIOR ART)
FIG. 3 is a front elevational view of the FIG. 1 hanger upon folding thereof.
Figure 4:
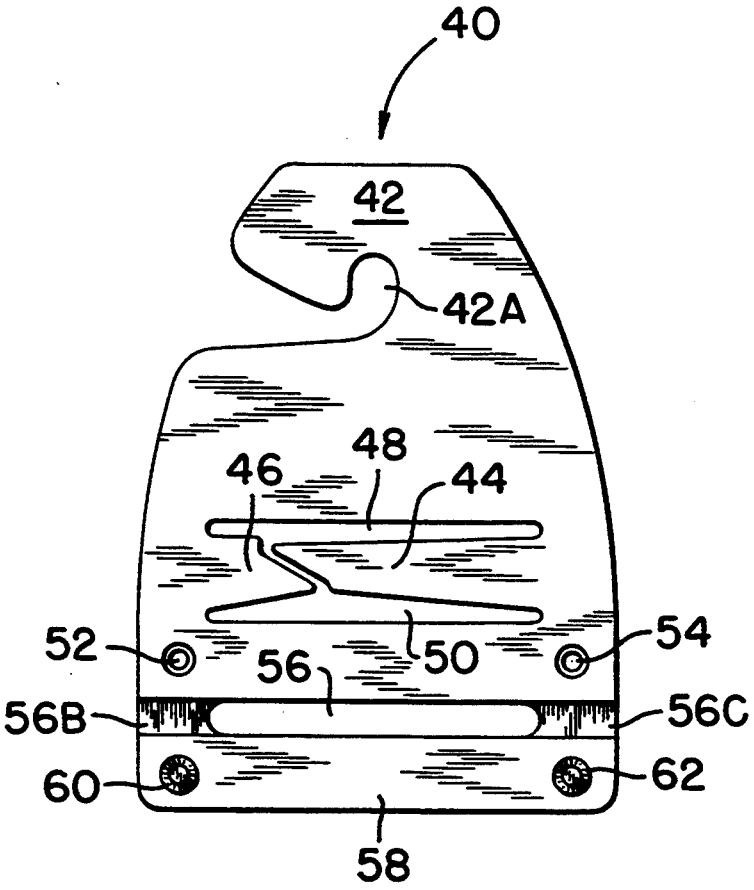
FIG. 4 is a front elevational view of a hanger in accordance with the subject invention.
Figure 5:
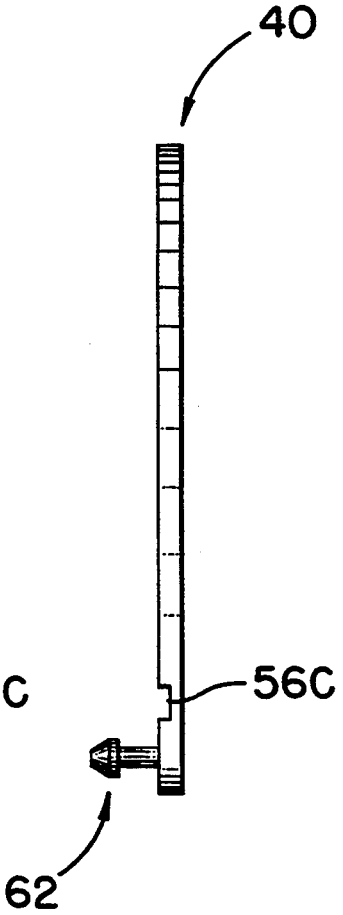
FIG. 5 is a right side elevational view of the FIG. 4 hanger.
Figure 6:
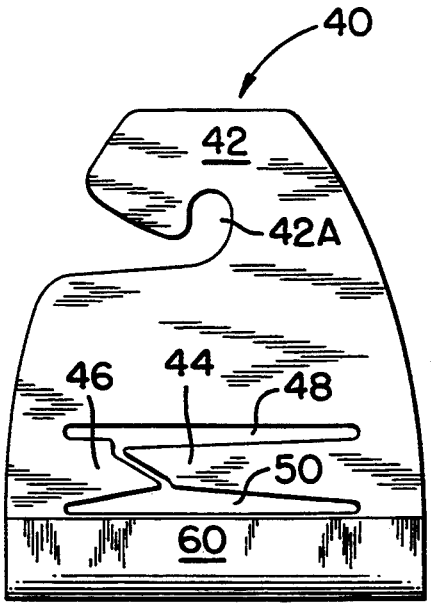
FIG. 6 is a front elevational view of the FIG. 4 hanger upon folding of its foldable part.
Figure 7:
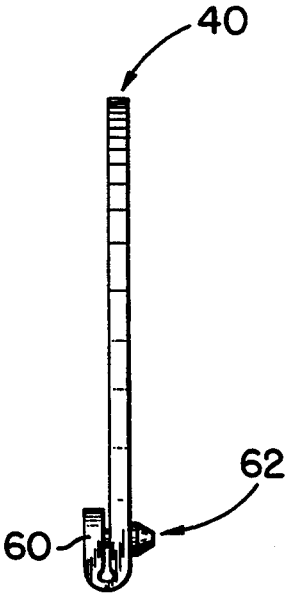
FIG. 7 is a side elevational view of FIG. 6.

As is seen in FIGS. 6 and 7, on folding of panel 60 about the fold line segment and insertion of the latching projections into the latching openings, the fold line is fully interior to the hanger which is aesthetically of advantage over the hanger of FIGS. 1–3. Further, since the folded member, i.e., panel 60, is of limited dimension in the fold direction, being about one-fifth of the hanger length vertically below the hook portion, the invention affords substantial savings in plastic material over the hanger of FIGS. 1–3.

Figure 8:
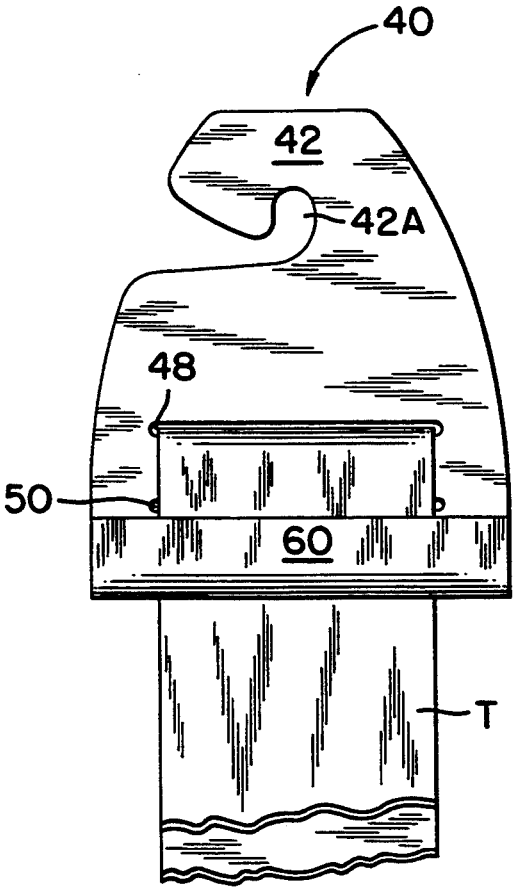
FIG. 8 is a repeat showing of FIG. 6 with a tie assembled with the hanger.

Openings 48, 50 and 56 are of substantially the same dimension laterally of the hanger, being selected to permit passage therethrough of, e.g, a folded tie. In use of the hanger, with the flap segment unfolded, arm 44 is pushed outwardly of the plane of the hanger and the loop of a folded tie is dressed onto arm 44 and, as arm 44 is returned to the plane of the hanger, the folded tie is further dressed about arm 46. The folded tie is now dressed into and through opening 50, whereupon panel 60 is folded about the fold line segment and against the tie and the central portion of the hanger and secured in such disposition by engagement of the projections 60 and 62 in latching openings 52 and 54. The resulting assembly is seen in FIG. 8, with tie T being half-folded prior to dressing thereof onto arms 44 and 46.

Various changes to the particularly disclosed embodiments and practices may evidently be introduced without departing from the invention. Accordingly, it is to be appreciated that the particularly discussed and depicted preferred embodiments and practices of the invention are intended in an illustrative and not in a limiting sense. The true spirit and scope of the invention are set forth in the ensuing claims.

What is claimed is:

1. A garment hanger comprised of a one-piece body having a hook portion for the receipt of a display rod, a central portion depending from said hook portion and having first and second openings therein, and a lower portion defining a fold line segment depending from said central portion with a third opening disposed in the fold line segment and a flap segment depending from said fold line segment, said central portion and said flap segment defining coactive means for retaining said flap segment against said central portion on folding of said flap segment about said fold line segment, a first upper continuous course of said central body portion upwardly bounding said first opening and a second lower continuous course of said central body portion lowerly bounding said second opening, said central body portion supporting first and second horizontally extending arms respectively lowerly bounding said first opening and upwardly bounding said second opening.

2. The garment hanger claimed in claim 1, wherein said first, second and third openings are of substantially equal dimension transversely of said garment hanger.

3. The garment hanger claimed in claim 1, wherein said coactive means is comprised of at least one projection on said flap segment and at least one latching opening in said central portion.

4. The garment hanger claimed in claim 1, wherein said coactive means is comprised of first and second projections on said flap segment adjacent respective lateral margins thereof and first and second latching openings in said central portion adjacent respective lateral margins thereof.

5. The garment hanger claimed in claim 1 wherein said first and second arms have respective free ends in interfering disposition vertically of said hanger.

6. The hanger claimed in claim 5, wherein said free ends of said first and second arms are disposed in horizontally spaced relation to each other.

7. The hanger claimed in claim 1, wherein said first arm defines an intermediate course extending generally downwardly of said hanger and a further course extending to said free end of said first arm.

8. The hanger claimed in claim 7, wherein said second arm defines an intermediate course extending generally upwardly of said hanger and a further course extending to said free end of said second arm.

9. The hanger claimed in claim 8, wherein said intermediate courses of said first and second arms are in interfering disposition vertically of said hanger.

10. In combination:

(a) a garment hanger comprised of a one-piece body having a hook portion for the receipt of a display rod, a central portion depending from said hook portion and having first and second openings therein, and a lower portion defining a fold line segment depending from said central portion with a third opening disposed in the fold line segment and a flap segment depending from said fold line segment, said central portion and said flap segment defining coactive means for retaining said flap segment against said central portion on folding of said flap segment about said fold line segment, said flap segment being folded about said fold line segment and said coactive means retaining said flap segment against said central portion; and (b) a garment having a first folded part looped through said first and second openings and second parts continuous with said first folded part, portions of said second parts extending through said third opening and being disposed between said central portion and said flap segment.

11. The invention claimed in claim 10, wherein said first, second and third openings are of substantially equal dimension transversely of said invention.

12. The invention claimed in claim 10, wherein said coactive means is comprised of at least one projection on said flap segment and at least one latching opening in said central portion.

13. The invention claimed in claim 10, wherein said coactive means is comprised of first and second projections on said flap segment adjacent respective lateral margins thereof and first and second latching openings in said central portion adjacent respective lateral margins thereof.

14. The invention claimed in claim 10 wherein a first upper continuous course of said central body portion upwardly bounds said first opening and a second lower continuous course of said central body portion lowerly bounds said second opening, said central body portion supporting first and second horizontally extending arms respectively lowerly bounding said first opening and upwardly bounding said second opening.

15. The invention claimed in claim 14 wherein said first and second arms have respective free ends in interfering disposition vertically of said hanger.

16. The hanger claimed in claim 15, wherein said free ends of said first and second arms are disposed in horizontally spaced relation to each other.

17. The hanger claimed in claim 14, wherein said first arm defines an intermediate course extending generally downwardly of said hanger and a further course extending to said free end of said first arm.

18. The hanger claimed in claim 17, wherein said second arm defines an intermediate course extending generally upwardly of said hanger and a further course extending to said free end of said second arm.

19. The hanger claimed in claim 18, wherein said intermediate courses of said first and second arms are in interfering disposition vertically of said hanger.

* * * * *